US008622515B2

(12) United States Patent
Yanase et al.

(10) Patent No.: US 8,622,515 B2
(45) Date of Patent: Jan. 7, 2014

(54) IMAGE FORMING APPARATUS INCLUDING LIQUID-EJECTION RECORDING HEAD

(75) Inventors: Norikazu Yanase, Kanagawa (JP); Makoto Kikura, Kanagawa (JP); Tsuguyori Kemma, Kanagawa (JP); Shingo Masaoka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 202 days.

(21) Appl. No.: 13/091,541

(22) Filed: Apr. 21, 2011

(65) Prior Publication Data

US 2011/0273511 A1 Nov. 10, 2011

(30) Foreign Application Priority Data

May 7, 2010 (JP) ..... 2010-106887

(51) Int. Cl.
*B41J 2/165* (2006.01)

(52) U.S. Cl.
USPC ..... 347/34

(58) Field of Classification Search
USPC ..... 347/34
See application file for complete search history.

(56) References Cited

U.S. PATENT DOCUMENTS

| | | | |
|---|---|---|---|
| 5,563,639 | A | 10/1996 | Cameron et al. |
| 5,614,930 | A | 3/1997 | Osborne et al. |
| 5,617,124 | A | 4/1997 | Taylor et al. |
| 5,680,162 | A | 10/1997 | Taylor et al. |
| 5,712,668 | A | 1/1998 | Osborne et al. |
| 5,742,303 | A | 4/1998 | Taylor et al. |
| 6,082,848 | A | 7/2000 | Taylor |
| 6,457,803 | B1 | 10/2002 | Ohkoda |
| 2001/0020962 | A1 | 9/2001 | Kanaya et al. |
| 2002/0163556 | A1* | 11/2002 | Premnath et al. ..... 347/35 |
| 2006/0214981 | A1 | 9/2006 | Fukasawa et al. |
| 2008/0143781 | A1 | 6/2008 | Inoue et al. |
| 2009/0174749 | A1 | 7/2009 | Kemma |
| 2010/0002048 | A1 | 1/2010 | Masaoka |
| 2010/0067938 | A1 | 3/2010 | Kemma et al. |

FOREIGN PATENT DOCUMENTS

| | | |
|---|---|---|
| CN | 1861402 | 11/2006 |
| EP | 0705699 A1 | 4/1996 |
| EP | 1059168 A2 | 12/2000 |

(Continued)

OTHER PUBLICATIONS

U.S. Appl. No. 12/914,358, filed Oct. 28, 2010.

(Continued)

*Primary Examiner* — Matthew Luu
*Assistant Examiner* — Justin Seo
(74) *Attorney, Agent, or Firm* — Cooper & Dunham LLP

(57) ABSTRACT

An image forming apparatus includes a carriage movable in a main scanning direction in the image forming apparatus; a recording head mounted on the carriage to eject droplets; a maintenance unit disposed outboard of a recording area in the main scanning direction of the carriage and including a first liquid receptacle to collect droplets not used for image formation; a first space provided between the recording area and the maintenance unit; and a first sloped member provided at a side of the first space close to the maintenance unit. The sloped member has a sloped portion inclined downwardly from an upper side toward a lateral side close to the recording area to guide droplet mist generated by ejection of droplets from the head to a lower part of the first space with movement of the carriage from a position facing the maintenance unit to a position facing the recording area.

12 Claims, 7 Drawing Sheets

(56) References Cited

FOREIGN PATENT DOCUMENTS

| | | | |
|---|---|---|---|
| EP | 1702760 | A1 | 9/2006 |
| JP | 2003-159824 | | 6/2003 |
| JP | 2004-330644 | | 11/2004 |
| JP | 2007-152688 | | 6/2007 |
| JP | 2008-149538 | | 7/2008 |
| JP | 2009-262492 | | 11/2009 |
| JP | 2009-298000 | | 12/2009 |
| WO | WO00/43209 | | 7/2000 |

OTHER PUBLICATIONS

Sep. 2, 2011 European search report in connection with counterpart European patent application No. 11 16 3732.

Chinese official action dated May 6, 2013 in corresponding Chinese patent application No. 2011 10 11 6488.0.

* cited by examiner

IMAGE FORMING APPARATUS INCLUDING LIQUID-EJECTION RECORDING HEAD

CROSS-REFERENCE TO RELATED APPLICATIONS

The present patent application claims priority pursuant to 35 U.S.C. §119 from Japanese Patent Application No. 2010-106887, filed on May 7, 2010 in the Japan Patent Office, which is hereby incorporated herein by reference in its entirety.

BACKGROUND

1. Technical Field

This disclosure relates to an image forming apparatus, and more specifically to an image forming apparatus including a recording head to eject liquid droplets.

2. Description of the Background Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head formed with a liquid ejection head (liquid-droplet ejection head) for ejecting droplets of ink. During image formation, the image forming apparatuses eject droplets of ink or other liquid from the recording head onto a recording medium to form a desired image.

Such inkjet-type image forming apparatuses fall into two main types: a serial-type image forming apparatus that forms an image by ejecting droplets from the recording head while moving the recording head in a main scanning direction of the carriage, and a line-head-type image forming apparatus that forms an image by ejecting droplets from a linear-shaped recording head held stationary in the image forming apparatus.

The serial-type image forming apparatus may include, for example, a linear encoder to detect the movement of a carriage mounted with a recording head. The linear encoder includes an encoder scale disposed parallel to the main scanning direction of the carriage and an encoder sensor formed with an optical sensor mounted on the carriage. Further, a rotary encoder is provided in the same manner to control sheet feeding.

In such an image forming apparatus employing a liquid ejection head, ink mist arises in ejecting liquid droplets for image formation and can obscure the scale marks, thus preventing precise positional control of the carriage and/or positional and speed control of sheet feeding.

To counteract the above-described effect, in one known approach a side face of the carriage is formed so as to guide airflow carrying ink mist toward an area in which an optical detection unit is not disposed. In another approach, for example, ink mist is suctioned into a hollow guide rod for guiding the carriage. Alternatively, the ink mist is suctioned using a suction unit or absorbed by an absorber.

However, the above-described approaches are not completely effective. Thus, for example, in a case in which at least one side face of a carriage is shaped to guide airflow, the ink mist is guided toward the front side of the carriage and consequently continuously stirred up, thus adhering to the encoder scale.

BRIEF SUMMARY

In an aspect of this disclosure, there is provided an image forming apparatus including a carriage movable in a main scanning direction in the image forming apparatus; a recording head mounted on the carriage to eject droplets; a maintenance unit disposed outboard of a recording area in the main scanning direction of the carriage and including a first liquid receptacle to collect droplets not used for image formation; a first space provided between the recording area and the maintenance unit; and a first sloped member provided at a side of the first space close to the maintenance unit. The sloped member has a sloped portion inclined downwardly from an upper side toward a lateral side close to the recording area to guide droplet mist generated by ejection of droplets from the recording head to a lower part of the first space with movement of the carriage from a position facing the maintenance unit to a position facing the recording area.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
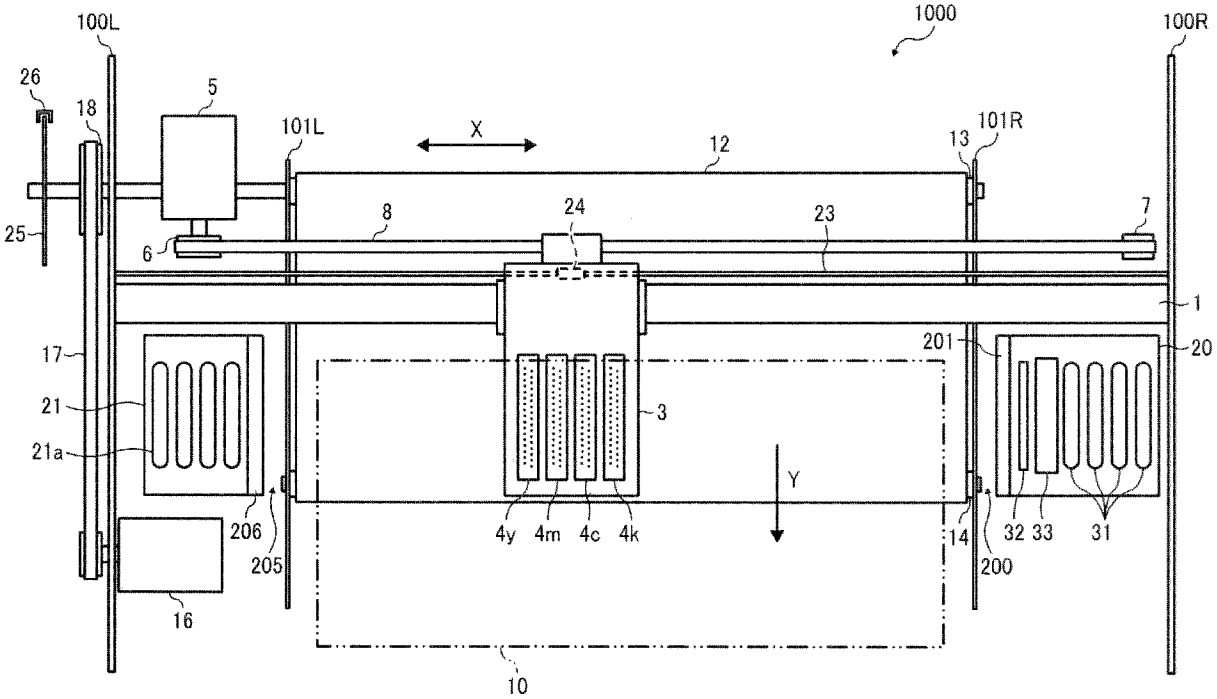
FIG. 1 is a schematic plan view of a mechanical section of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium. The term "ink" used herein is not limited to "ink" in a narrow sense and includes anything useable for image formation, such as a DNA sample, resist, pattern material, washing fluid, storing solution, and fixing solution. The term "image" used herein is not limited to a two-dimensional image and includes, for example, an image applied to a three dimensional object and a three dimensional object itself formed as a three-dimensionally molded image. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Figure 2:
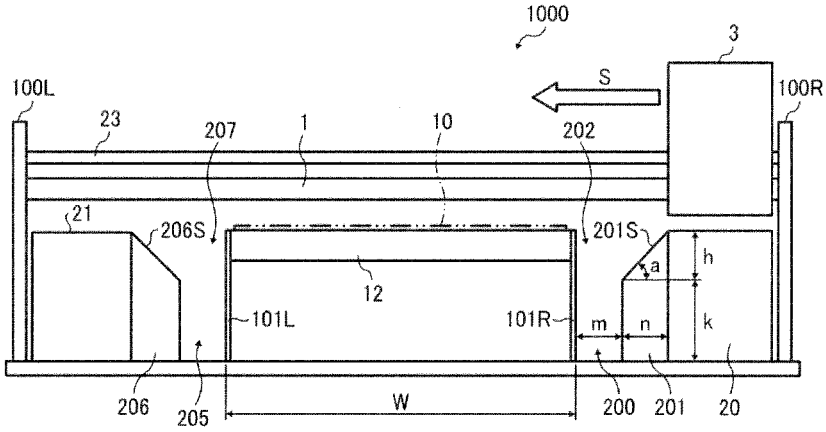
FIG. 2 is a schematic front view of the mechanical section of the image forming apparatus illustrated in FIG. 1.

First, an inkjet recording apparatus is described as an image forming apparatus according to an exemplary embodiment of the present disclosure with reference to FIGS. 1 and 2.

FIG. 1 is a plan view of a schematic configuration of the inkjet recording apparatus 1000. FIG. 2 is a front view of the inkjet recording apparatus 1000 of FIG. 1.

The inkjet recording apparatus 1000 includes a main guide rod 1, a sub guide member, left and right side plates 100L and 100R, a carriage 3, a main scan motor 5, a driving pulley 6, a driven pulley 7, and a timing belt 8. The main guide rod 1 and the sub guide member extend between the side plates 100L and 100R to support the carriage 3. The carriage 3 supported with the main guide rod 1 and the sub guide member is slidable in a main scanning direction indicated by a double arrow X in FIG. 1. The carriage 4 is moved for scanning in the main scanning direction by the main scan motor 5 via the timing belt 8 extended between the driving pulley 6 and the driven pulley 7.

On the carriage 3, for example, recording heads 4*y*, 4*m*, 4*c*, and 4*k* (hereinafter referred to as "recording heads 4" unless colors distinguished) are mounted to eject ink droplets of yellow (Y), magenta (M), cyan (C), and black (K), respectively. The recording heads 4 are mounted on the carriage 3 so that a plurality of nozzle rows each including multiple nozzle orifices is arranged in a direction (sub-scan direction indicated by an arrow Y in FIG. 1) perpendicular to the main scanning direction and ink droplets are ejected downward from the nozzles.

As a pressure generator to generate pressure for ejecting droplets, liquid ejection heads constituting the recording heads 4 may employ, for example, piezoelectric actuators such as piezoelectric elements, thermal actuators that generates film boiling of liquid (ink) using electro/thermal conversion elements such as heat-generation resistant to cause a phase change, shape-memory-alloy actuators to change a metal phase by a temperature change, or electrostatic actuators that generate pressure by electrostatic force.

The inkjet recording apparatus 1000 also includes a conveyance belt 12 serving as a conveyance unit to convey a sheet 10 to a position opposite the recording heads 4 with the sheet 10 electrostatically attached thereon. The conveyance belt 12 is an endless belt extended between a conveyance roller 13 and a tension roller 14 so as to circulate in a belt traveling direction (sub-scan direction). The conveyance roller 13 and the tension roller 14 are supported between sub side plates 101L and 101R. A charge roller 15 charges (i.e., applies electric charges to) the surface of the conveyance belt 12 circulating in the belt traveling direction.

The conveyance roller 13 is rotated by a sub-scan motor 16 via a timing belt 17 and a timing pulley 18. The rotation of the conveyance roller 13 causes the conveyance belt 12 to circulate in the sub-san direction indicated by the arrow Y illustrated in FIG. 1.

At one end in the main scanning direction of the carriage 3, a maintenance unit 20 is disposed near one lateral side of the conveyance belt 12 to maintain and recover nozzle conditions of the recording heads 4.

The maintenance unit 20 includes, for example, cap members 31, a wiping member 32, and a first liquid receptacle 33. Each of the cap members 31 caps a nozzle face of the corresponding one of the recording heads 4. The wiping member 32 wipes the nozzle faces of the recording heads 4. The first liquid receptacle 33 receives droplets not used for image formation (e.g., droplets ejected for maintenance).

At the other end in the main scanning direction of the carriage 3, a second liquid receptacle 21 is disposed near the other lateral side of the conveyance belt 12 to receive ink droplets not used for image formation (e.g., droplets ejected for maintenance).

The inkjet recording apparatus 1000 includes a linear encoder (main scan encoder) to detect the movement of the carriage 3. The linear encoder also includes an encoder scale 23 and a first encoder sensor 24. The encoder scale 23 with a predetermined pattern extends between the side plates 100L and 100R in the main scanning direction of the carriage 3. The first encoder sensor 24, e.g., a transmissive photosensor is provided at the carriage 3 to read the pattern of the encoder scale 23.

The inkjet recording apparatus 1000 further includes a rotary encoder (sub-scan encoder) to detect the moving distance and position of the conveyance belt 12. The rotary encoder includes a code wheel 25 of high resolution and a second encoder sensor 26. The code wheel 25 with a predetermined pattern is mounted on the shaft of the conveyance roller 13. The second encoder sensor 26, e.g., a transmissive photosensor detects the pattern of the code wheel 25.

In the inkjet recording apparatus 1000 having the above-described configuration, a sheet 10 fed from a sheet feed tray is attached onto the conveyance belt 12 charged by the charge roller 15 and conveyed in the sub-scan direction by the circulation of the conveyance belt 12. While moving the carriage 3 in the main scan direction, the inkjet recording apparatus 1000 drives the recording heads 4 in response to image signals to eject ink droplets onto the sheet 10 on the conveyance belt 12 stopped. After recording a first band of an image, the sheet 10 is conveyed at a certain distance and a second band of the image is recorded on the sheet 10. On receiving a recording end signal or a signal indicating that a rear end of the sheet 10 has reached a recording area of the recording heads 4, the inkjet recording apparatus 1000 terminates the image recording and outputs the sheet 10 to an output tray.

Next, a configuration of guiding mist to a lower part of the image forming apparatus 1000 is described with reference to FIG. 2.

A first space 200 is provided between the maintenance unit 20 and the recording area W of the recording heads 4 (the sub right-side plate 101R in FIG. 2), and a first sloped member 201 is provided at a side of the first space 200 close to the maintenance unit 20 or integrally formed with the maintenance unit 20. Thus, the first space 200 is defined by the first sloped member 201 at a side close to the maintenance unit 20, and the first sloped member 201 has a sloped portion 201S inclined downwardly from an upper side (an upper opening 202 of the first space 200) toward a lateral side close to the recording area W (the sub right-side plate 101R in FIG. 2).

A second space 205 is provided between the second liquid receptacle 21 and the recording area W of the recording heads 4 (e.g., the sub left-side plate 101L in FIG. 2), and a second sloped member 206 is provided at a side of the second space 205 close to the second liquid receptacle 21 or integrally formed with the second liquid receptacle 21. Thus, the second space 205 is defined by the second sloped member 206 at a side close to the second liquid receptacle 21, and the second sloped member 206 has a sloped portion 206S inclined downwardly from an upper side (an upper opening 207 of the second space 205) toward a lateral side close to the recording area W (the sub left-side plate 101L in FIG. 2).

Figure 3:
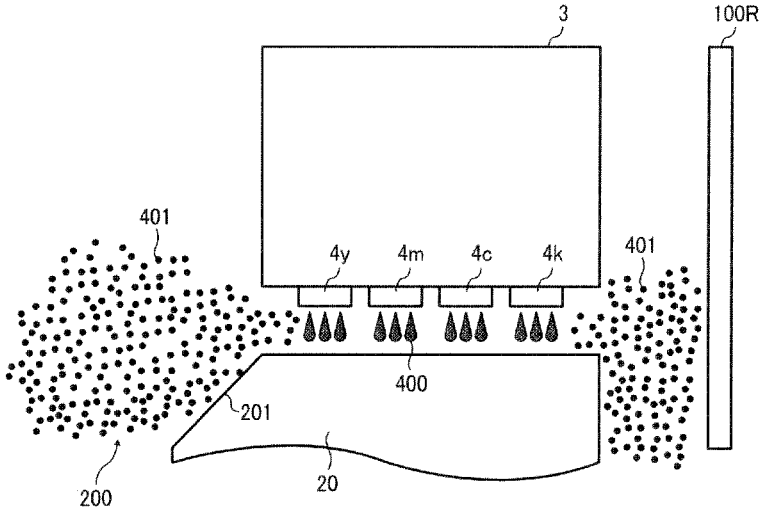
FIG. 3 is a schematic view of ink mist generated by maintenance ejection in the image forming apparatus.
Figure 4:
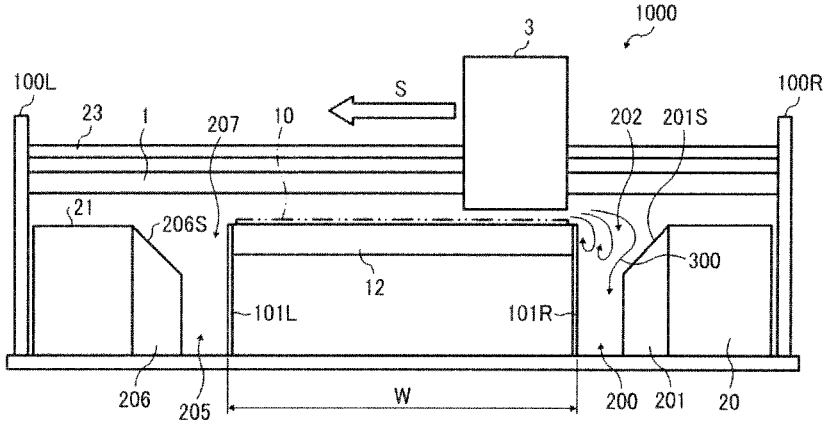
FIG. 4 is a schematic view of airflow generated by movement of a carriage.
Figure 5:
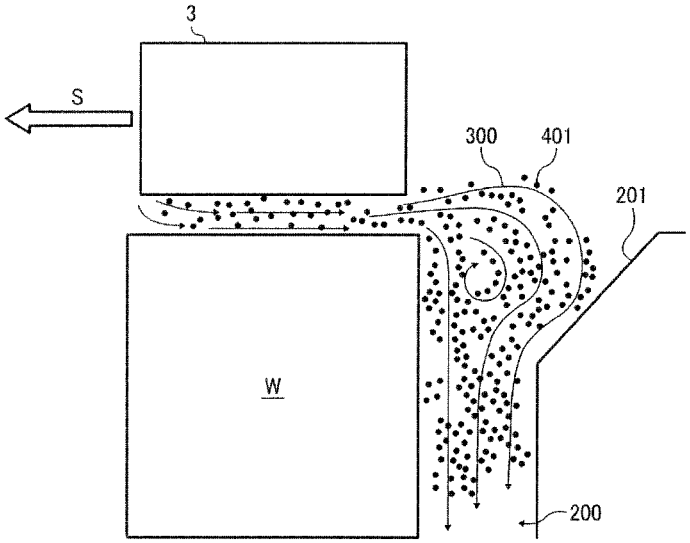
FIG. 5 is a schematic view of ink mist guided by airflow.

With such a configuration, for example, on starting image recording or at a predetermined timing in image recording, the recording heads 4 eject ink droplets 400 toward the first liquid receptacle 33 of the maintenance unit 20 for maintenance. At that time, ink mist 401 is scattered as illustrated in FIG. 3. At this state, when the carriage 3 moves in a direction indicated by an arrow S in FIG. 2, as illustrated in FIGS. 4 and 5, the carriage 3 passes above the first space 200 and arrives at a position opposing the conveyance belt 12. At that time, air is guided by the first sloped member 201 backward in the moving direction S of the carriage 3, thus creating an airflow 300 toward a lower part of the first space 200.

Figure 6:
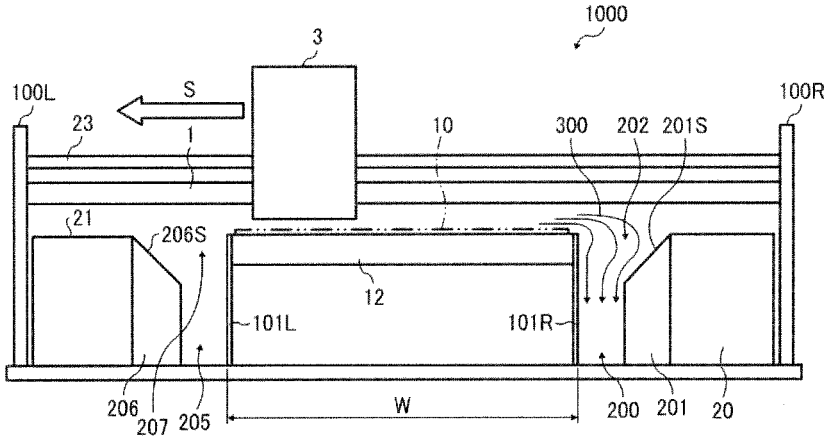
FIG. 6 is a schematic view of airflow generated by movement of the carriage.

The airflow 300 going toward the lower part of the first space 200 guides the ink mist 401 involved with the maintenance ejection toward the lower part of the first space 200, thus minimizing the rising-up of the ink mist 401. Accordingly, the amount of the ink mist attached to the encoder scale 23 decreases, thus reducing smear of the encoder scale 23. Further, as illustrated in FIG. 6, the airflow 300 toward the lower part of the first space 200 is created for a while after the carriage 3 arrives at the position opposing the recording area W of the first space 200.

Figure 7:
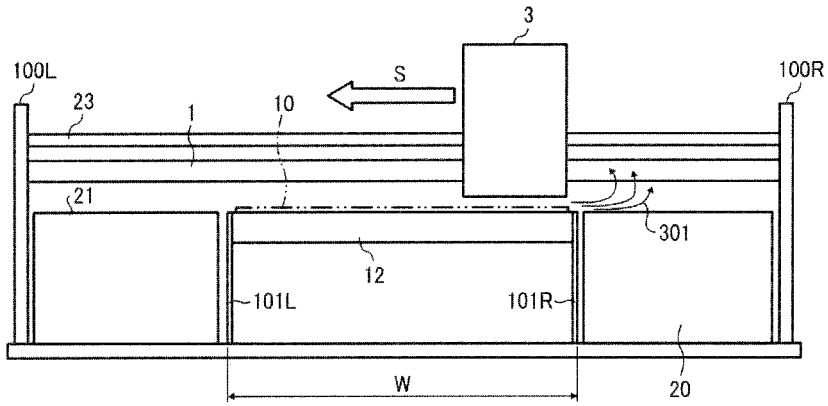
FIG. 7 is a schematic view of airflow generated by movement of a carriage in an image forming apparatus according to a comparative example.
Figure 8:
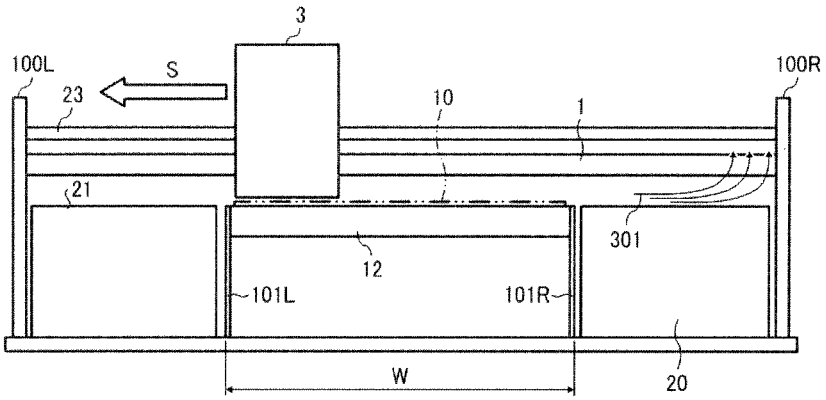
FIG. 8 is a schematic view of airflow generated by movement of the carriage in the image forming apparatus illustrated in FIG. 7.

By contrast, as illustrated in FIG. 7, in a case in which such a space defined by a sloped member is not provided between the maintenance unit 20 and the sub right-side plate 101R, the pressure at the rear side of the carriage 3 relatively decreases, thus creating an airflow going toward the rear side of the carriage 3. Further, as illustrated in FIG. 8, an airflow 301 goes up, thus causing ink mist involved with maintenance ejection to rise up. As a result, the ink mist attaches to the encoder scale 23, thus causing smear of the encoder scale 23.

Hence, in the present exemplary embodiment, as described above, the first space is provided between the recording area and the maintenance unit. The first space is defined by the first sloped member at a side close to the maintenance unit, and the sloped portion of the first sloped member is inclined downwardly from a portion of a first upper opening close to the maintenance unit toward a side close to the recording area. Accordingly, when the carriage moves from a position close to the maintenance unit to a position close to the recording area, ink mist is guided toward a lower part of the first space. Such a configuration guides the mist toward a lower part of the image forming apparatus, thus minimizing the drift of ink mist in the air and the smear of the encoder.

Next, the first space 200 is described with reference to FIG. 2.

The angle "a" of the sloped portion 201S of the first sloped member 201 is preferably in a range of 30°≤a≤60°. Each of the width "m" of the first space 200 in the main scan direction, the width "n" of the sloped portion 201S of the first sloped member 201 in the main scan direction, the height "h" of the sloped portion 201S of the first sloped member 201, and the height "k" of the first space 200 excluding the height "h" of the sloped portion 201S of the first sloped member 201 is preferably 5 mm or more. If the angle "a" is smaller than 30°, less of the airflow may go downward. By contrast, if the angle "a" is greater than 60°, the airflow may go downward and rise up again. If each of the widths "m" and "n" and the heights "h" and "k" is less than 5 mm, ink mist is not guided downward.

Table 1 shows results of evaluating airflow flowing into the first space 200 using the angle "a" and the widths "m" and "n" as parameters. The height "h" of the sloped portion 201S of the first sloped member 201 is determined by the angle "a" and the width "n", and the height "k" of the first space 200 excluding the sloped portion 201S of the first sloped member 201 is determined by the height "h" of the sloped portion 201S of the first sloped member 201 and the other configuration of the image forming apparatus. In table 1, "A" represents that airflow goes into the first space 200, "B" represents that a portion of airflow goes into the first space 200 and the amount of airflow going into the first space 200 is equivalent to that obtained in a case in which the first space 200 has no sloped portion, and "C" represents that no airflow goes into the first space 200.

TABLE 1

| | | m [mm] | | | | |
|---|---|---|---|---|---|---|
| n [mm] | a [deg] | 2 | 3 | 4 | 5 | 6 |
| 4 | 20 | C | C | C | C | C |
| | 25 | C | C | C | B | B |
| | 30 | B | B | B | B | B |
| | 60 | B | B | B | B | B |
| | 65 | B | B | B | B | B |
| | 70 | B | B | B | B | B |
| 5 | 20 | C | C | C | C | C |
| | 25 | C | B | B | B | B |
| | 30 | B | B | B | A | A |
| | 60 | B | B | B | A | A |
| | 65 | B | B | B | B | B |
| | 70 | B | B | B | B | B |
| 6 | 20 | C | C | C | C | C |
| | 25 | C | B | B | A | A |
| | 30 | B | B | A | A | A |
| | 60 | B | B | A | A | A |
| | 65 | B | B | A | A | A |
| | 70 | B | B | B | B | B |

In the above-described exemplary embodiment, guidance of ink mist to the first space 200 at the side close to the maintenance unit 20 is described. Likewise, ink mist is guided to the second space 205 at the side close to the second liquid receptacle 21.

Next, a second exemplary embodiment of the present disclosure is described with reference to FIG. 9.

Figure 9:
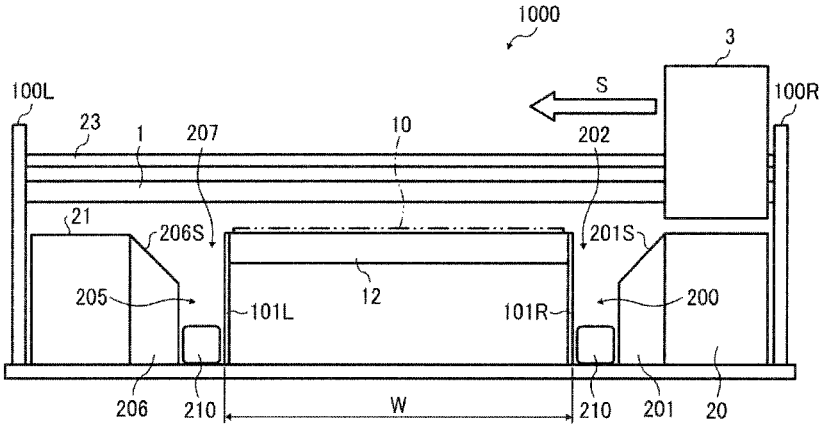
FIG. 9 is a front view of an image forming apparatus according to a second exemplary embodiment.

FIG. 9 is a front view of an inkjet recording apparatus 1000 according to the second exemplary embodiment. In FIG. 9, an absorber 210 is provided at a bottom portion of the first space 200 to absorb ink mist. With such a configuration, the absorber 210 can absorb and retain ink mist guided by airflow from an upper portion to a lower part in the first space 200. Thus, the absorber 210 serves as a filter, preventing the ink mist from rising from the first space 200 again.

Next, a third exemplary embodiment of the present disclosure is described with reference to FIG. 10.

Figure 10:
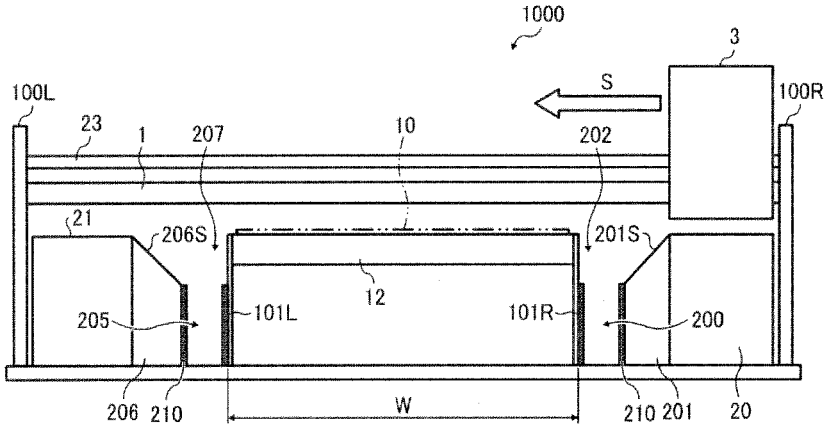
FIG. 10 is a front view of an image forming apparatus according to a third exemplary embodiment.

FIG. 10 is a front view of an inkjet recording apparatus 1000 according to the third exemplary embodiment. In FIG. 10, an absorber 210 of a cylindrical shape is provided between lateral side faces of the first space 200 to absorb ink mist. With such a configuration, the absorber 210 can absorb and retain ink mist guided by airflow from an upper portion to a lower part in the first space 200. Thus, the absorber 210 serves as a filter, preventing the ink mist from rising from the first space 200 again and absorbing the ink mist at an earlier stage than the second exemplary embodiment.

Next, a fourth exemplary embodiment of the present disclosure is described with reference to FIG. 11.

Figure 11:
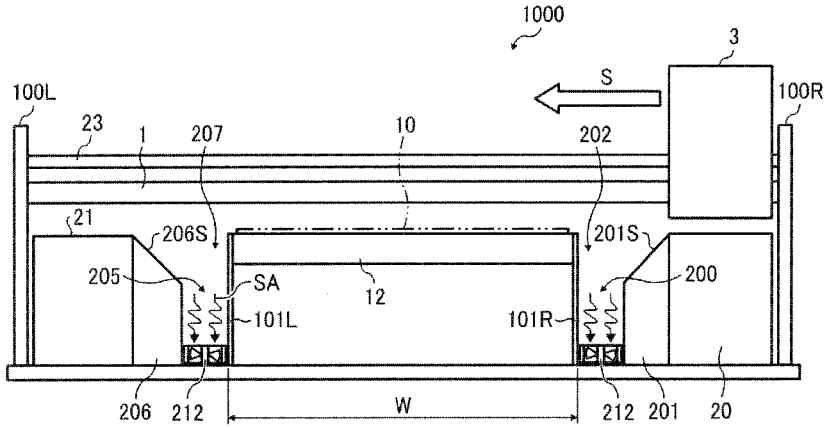
FIG. 11 is a front view of an image forming apparatus according to a fourth exemplary embodiment.

FIG. 11 is a front view of an inkjet recording apparatus 1000 according to the fourth exemplary embodiment. In FIG. 11, a suction fan 212 is provided at a bottom portion of the first space 200 to generate airflow. With such a configuration, suctioning of the suction fan 212 (indicated by arrows SA in FIG. 11) can effectively generate airflow going from an upper portion to a lower part in the first space 200, thus guiding ink mist downward.

Next, a fifth exemplary embodiment of the present disclosure is described with reference to FIG. 12.

Figure 12:
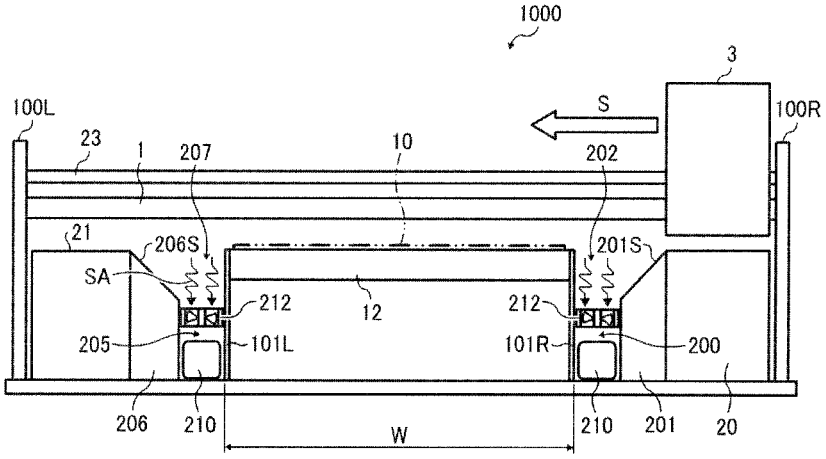
FIG. 12 is a front view of an image forming apparatus according to a fifth exemplary embodiment.

FIG. 12 is a front view of an inkjet recording apparatus 1000 according to the fifth exemplary embodiment. In FIG. 12, an absorber 210 is provided at a bottom portion of the first space 200 to absorb ink mist and a suction fan 212 is provided above the absorber 210 to generate airflow. With such a configuration, suctioning of the suction fan 212 can effectively generate airflow going from an upper portion to a lower part in the first space 200, thus guiding ink mist downward. In addition, the absorber 210 can serve as a filter to absorb and retain the guided ink mist, thus further reducing the amount of ink mist scattered and the smear of the encoder.

As described above, the smear of the encoder is reduced, thus reducing operation failures in the positional control of the carriage or the sheet feed control.

In the above-described exemplary embodiments, the image forming apparatus is described as a printer. However, it is to be noted that the image forming apparatus is not limited to such a printer and may be, for example, a multifunctional device having two or more capabilities of a printer, a facsimile machine, and a copier. Further, the image forming apparatus may be an image forming apparatus using a recording liquid other than "ink" in strict meaning, fixing solution, or patterning material.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a carriage movable in a main scanning direction in the image forming apparatus;

a recording head mounted on the carriage to eject droplets;

a maintenance unit disposed outboard of a recording area in the main scanning direction of the carriage, the maintenance unit comprising a first liquid receptacle to receive droplets ejected, by the recording head, for maintenance and not used for image formation;

a first space provided between the recording area and the maintenance unit; and a first sloped member disposed between the first liquid receptacle and the recording area and provided at a side of the first space and next to the maintenance unit, the sloped member comprising a sloped portion inclined downwardly from an upper side toward a lateral side of the recording area to guide droplet mist generated by ejection of droplets from the recording head to a lower part of the first space with movement of the carriage from a position facing the maintenance unit to a position facing the recording area.

2. The image forming apparatus according to claim 1, wherein the first sloped member is integrally formed with the maintenance unit.

3. The image forming apparatus according to claim 1, further comprising:

a second liquid receptacle disposed at an opposite side of the recording area opposing the first liquid receptacle in the main scanning direction of the carriage to collect droplets not used for image formation;

a second space provided between the recording area and the second liquid receptacle; and a second sloped member provided at a side of the second space and next to the second liquid receptacle, the second sloped member comprising a sloped portion inclined downwardly from an upper side toward a lateral side of the recording area to guide droplet mist generated by ejection of droplets from the recording head to a lower part of the second space with movement of the carriage from a position facing the second liquid receptacle to a position facing the recording area.

4. The image forming apparatus according to claim 3, wherein the second sloped member is integrally formed with the second liquid receptacle.

5. The image forming apparatus according to claim 3, further comprising an absorber disposed in at least one of the first space and the second space to absorb the droplet mist.

6. The image forming apparatus according to claim 3, further comprising an absorber disposed at a lower part of at least one of the first space and the second space to absorb the droplet mist.

7. The image forming apparatus according to claim 3, further comprising an absorber disposed at a lateral side part of at least one of the first space and the second space to absorb the droplet mist.

8. The image forming apparatus according to claim 3, further comprising a filter disposed in at least one of the first space and the second space.

9. The image forming apparatus according to claim 3, further comprising a filter disposed at a lower part of at least one of the first space and the second space.

10. The image forming apparatus according to claim 8, further comprising a filter disposed at a lateral side part of at least one of the first space and the second space.

11. The image forming apparatus according to claim 3, further comprising a suction fan disposed in at least one of the first space and the second space.

12. The image forming apparatus according to claim 1, wherein an angle a between the sloped portion of the sloped member and a horizontal plane is in a range of $30° \leq a \leq 60°$.

* * * * *